United States Patent [19]

Blumenthal

[11] 4,449,322

[45] May 22, 1984

[54] HANDLE OPERABLE VEHICLES

[76] Inventor: Martin Blumenthal, 99 Longview Ave., Chatham, N.J. 07928

[21] Appl. No.: 382,631

[22] Filed: May 27, 1982

[51] Int. Cl.[3] ..... A63H 11/10; B62B 3/00

[52] U.S. Cl. ..... 46/202; 280/47.34

[58] Field of Search ..... 46/202, 210, 201, 205, 46/16; 280/87.01, 47.34

[56] References Cited

U.S. PATENT DOCUMENTS 3,762,096 10/1973 Reyes ..... 46/210
3,835,580 9/1974 Keces ..... 46/11
4,304,067 12/1981 Petrosky ..... 46/220

FOREIGN PATENT DOCUMENTS 1129406 5/1962 Fed. Rep. of Germany ..... 46/202

*Primary Examiner*—Mickey Yu
*Attorney, Agent, or Firm*—George E. Kersey

[57] ABSTRACT

A vehicle with a handle that is readily releasable for an auxiliary use, such as a shovel. The releasable end of the handle is in the form of a shovel blade that is receivable in a slot in the housing of the vehicle, such as a cab portion. The slot is "T" shaped, with the cross bar of the "T" receiving the blade and the stem of the "T" guiding the handle near its connection to the blade.

6 Claims, 6 Drawing Figures

HANDLE OPERABLE VEHICLES

BACKGROUND OF THE INVENTION

This invention relates to toy vehicles, and, more particularly, to toy vehicles which are operated by handles.

Toys are commonly provided with handles to facilitate their manipulation by children. A typical example is a toy wagon where the handle is used for steering, for coupling to other vehicles, and for simple towing. The usual handle is pivotally secured to its associated vehicle. It can generally be removed only by the release of fasteners and the like. In some situations it is desirable to remove the handle, and to do so without leaving structural projections which could possibly cause injury to the child. In other situations it is desirable for the toy vehicle to be provided with accessories that frequently are associated with the use of the toy. For example, a toy wagon is often used with a toy shovel. It would be desirable for the shovel to be associated with the wagon in a way that would mitigate against its becoming separated from the vehicle or misplaced so that it would not be available for use when desired.

Accordingly, it is an object of the invention to facilitate the use of handle operated toy vehicles.

Another object of the invention is to provide a handle operable toy vehicle in which the handle may be readily disengaged from the vehicle when not needed. A related object is to permit expedited disengagement of the handle from the vehicle without leaving undesirable projections that could otherwise cause injury to the user.

Still another object of the invention is to provide an easily releasable handle that can serve accessory functions, for example, such as in shovelling.

Yet another object of the invention is to provide for storage of an accessory that is useful with the toy vehicle, such as a shovel, in a way that limits the tendency for the shovel to be misplaced or separated from the vehicle.

SUMMARY OF THE INVENTION

In accomplishing the foregoing and related objects, the invention provides a vehicle with an apertured housing for receiving an accessory in the aperture. The accessory is engaged in the housing when used in the operation of the vehicle. It is releasable from the housing for auxiliary uses, particularly in connection with the vehicle.

Illustratively the vehicle is a toy, such as a dump truck, and the aperture is in the cab portion of the truck. In such a case the accessory may take the form of a shovel, with a blade end that is engageable in the aperture of the housing and can be used, in that position, for towing the toy truck. The shovel is also disengageable from the cab, permitting its blade end to be released and used, for example, in loading the dump portion of the toy truck with dirt or sand.

In accordance with one aspect of the invention, the accessory is a handle that can be used for maneuvering the vehicle. In accordance with another aspect of the invention, the handle is provided with a blade that is engageable in the aperture and is removable for service as a shovel.

In accordance with a further aspect of the invention, the aperture is a T-shaped slot. The stem of the "T" portion serves as a guide for the handle and the cross arms of the "T" consititute an opening for receiving the blade of the shovel.

In accordance with yet another aspect of the invention, the housing includes an internal semicircular track, which straddles at least a portion of the slot in the housing, to facilitate movement, such as rotation, of the accessory within the housing.

In accordance with a still further aspect of the invention, the portion of the handle connected to the blade has an upper curved surface to facilitate the release of the blade from the housing. The desired release takes place when the handle is elevated to the release portion of the slot in the housing, for example the cross bar in the case of a T-shaped slot. The stem of the T-shaped slot desirably has substantially the same width as the tongue of the handle.

In the case of a toy vehicle, the accessory aperture advantageously is in the form of a T-shaped slot with the cross arms of the slot in the roof of an associated housing and the stem of the slot in a frontal portion of the housing.

DESCRIPTION OF THE DRAWINGS

Other aspects of the invention will become apparent after considering several illustrative embodiments taken in conjunction with the drawings, in which.

DETAILED DESCRIPTION

Figure 1:
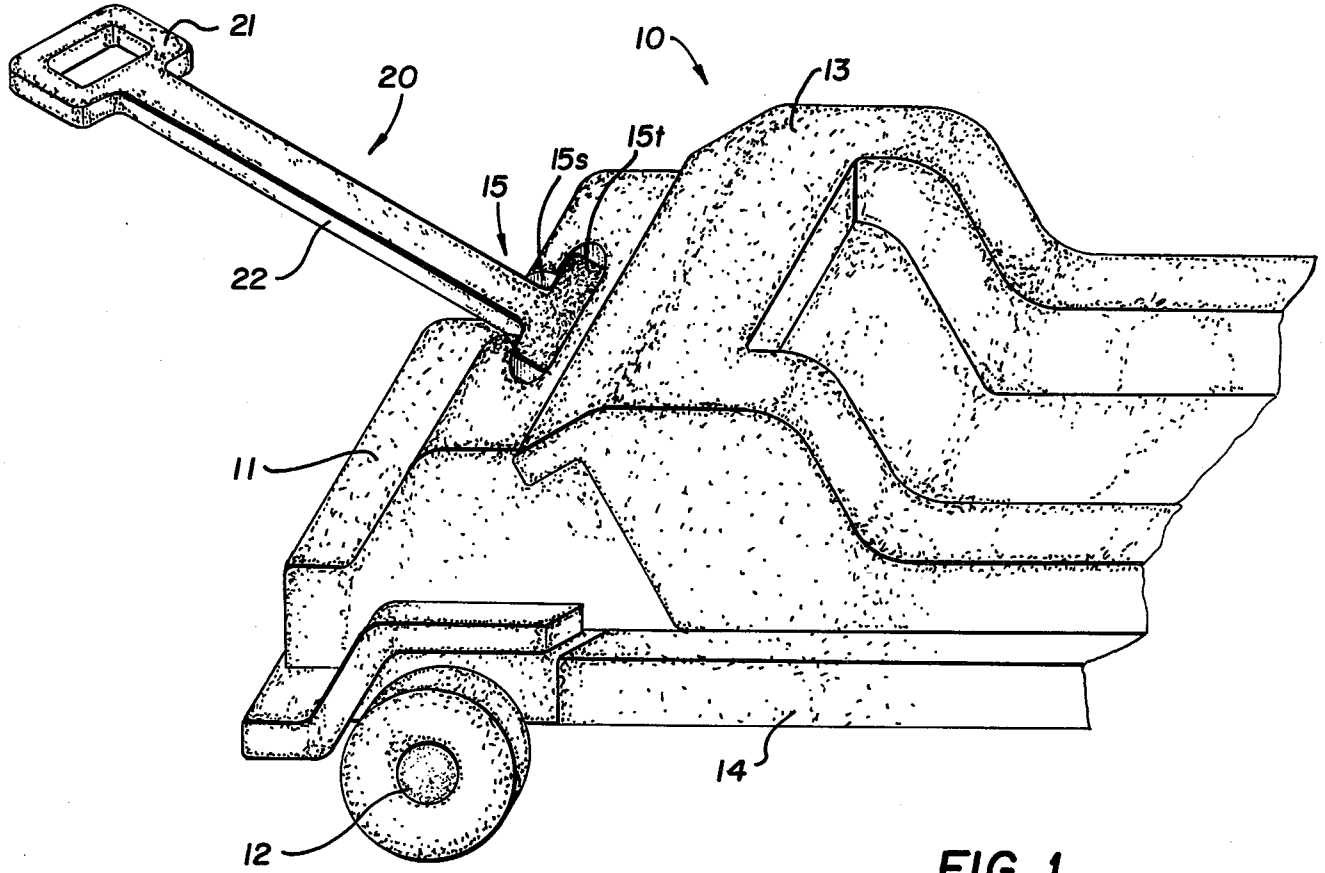
FIG. 1 is a partial perspective view of a toy vehicle in accordance with the invention.

With reference to the drawings, a toy vehicle 10 in accordance with the invention is shown in partial perspective view in FIG. 1 with an accessory, multipurpose handle 20.

The vehicle 10 illustratively is a toy dump truck with a cab 11 over an front axle 12. Behind the cab is a dumper 13 that can be mounted on the chassis 14 in any convenient fashion. the cab 11 further includes a slot 15 in the form of a "T"-shaped opening with a stem **15*s* extending downwardly along the front of the cab 11 and being joined at the roof of the cab with a transverse opening 15*t* that constitutes the side or cross arms of the "T"-shaped opening. The handle 20 includes a tow portion 21 that, in the case of a toy, is adapted to be gripped the hand of the user. A tongue 22 extends from the portion 21 into the stem portion of the slot 15*s* and is engaged within the cab 11** in the fashion illustrated in greater detail below.

Figure 2A:
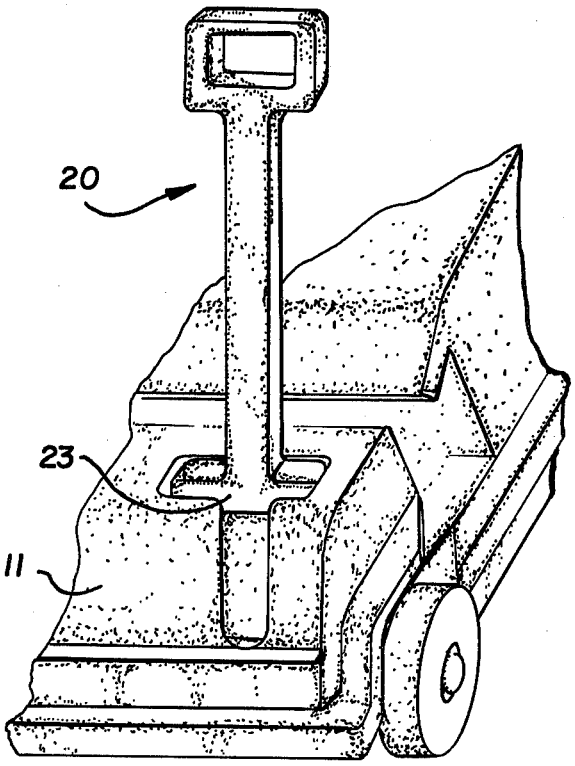
FIG. 2A is a partial perspective view of the frontal portion of the toy of FIG. 1 with its accessory member in position for being removed.

When the handle 20 is elevated as shown in FIG. 2A, the portion 23 within the cab 11 is in position for removal from the cab. As indicated in FIG. 2B, removal takes place by simply elevating the handle 20 in the direction indicated by the upwardly pointing arrow A.

Figure 2B:
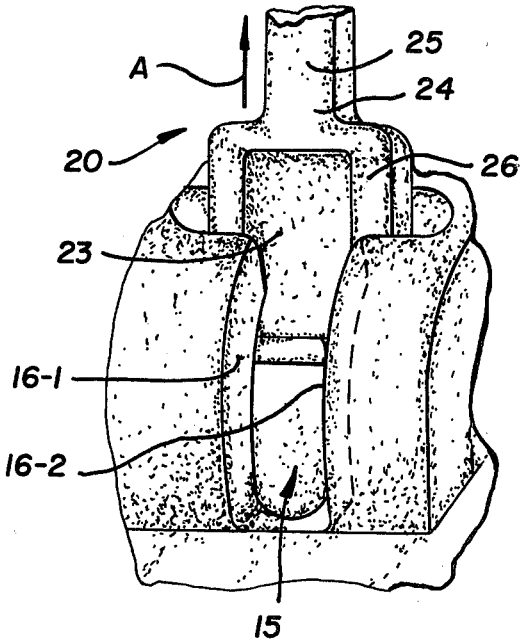
FIG. 2B is a further view of the toy in FIG. 2A showing the accessory member in the course of being removed.

In the withdrawal position of FIG. 2B, the portion 23 is seen to constitute a blade of a shovel. The neck 24 where the tongue 25 is connected to the spade 23 is suitable rounded to facilitate disengagement of the shovel 20 from the side walls 16-1 and 16-2 of the aperture 15. In addition, the blade 23 includes a rounded peripheral flange 26 which also facilitates the movement of the blade 23 within the cab 11 along and with respect to the side walls 16-1 and 16-2 of the slot 15.

Figure 3A:
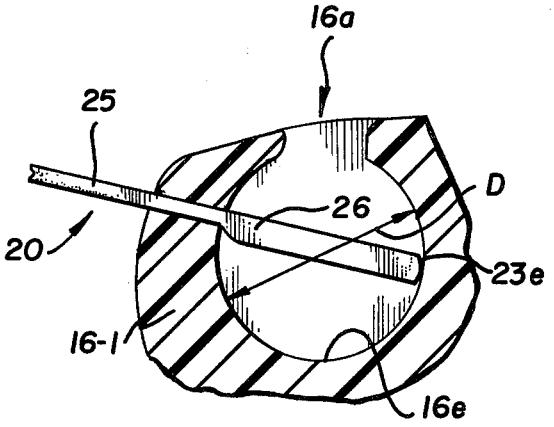
FIG. 3A is a cross sectional view of the cab portion of the vehicle of FIG. 1 showing the internal guide included in the housing for the accessory.
Figure 3B:
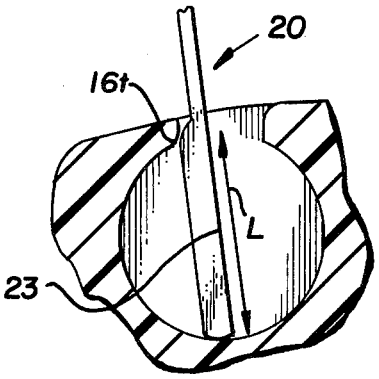
FIG. 3B is a further cross sectional view corresponding to FIG. 3A in which the accessory has been elevated to a final position preparatory to being removed.
Figure 3C:
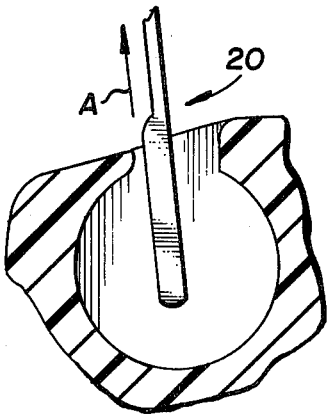
FIG. 3C corresponds to FIG. 3B with the accessory shown in the course of being removed.

The foregoing matters are more clearly illustrated in FIGS. 3A through 3C. In FIG. 3A, which is a cross sectional view of the cab corresponding to FIG. 1, the handle 20 is shown in its conventional position for towing, with the tongue 25 desirably in slidable engagement with the side walls 16-1 and 16-2, of which only side wall 16-1 is visible in FIG. 3A. Simultaneously the rounded edge of the flange 26 engages the edge **16*e* of the side wall 16-1. It is to be noted that the edge 16*e* is semicircular with an opening 16*o* that coincident with the opening for the arm portion 15*p* of the slot 15. In addition the semicircular edge 16*e* desirably has a diameter D which is substantially equal to the length L of the blade 23. As a result, the lower edge 23*e* of the blade 23 rides along the edge 16*e* as the handle 20 is elevated until it reaches the removal position shown in FIG. 3B**.

As indicated in FIG. 3B, the top portion **16*t* of the edge 16*e* is rounded to facilitate disengagement of the shovel 20 from the slot 15. Once the shovel 20 is in the withdrawal position of FIG. 3B, it is removed along the direction of the arrow A as shown in FIG. 3C**.

In the case of the toy vehicle 10 of FIG. 1, once the shovel 20 is removed, it can be used in loading the dumpster 13 with sand or dirt. It will be appreciated that although the invention has been illustrated in the context of a toy vehicle the disclosed principle of combining an accessory with a housing whose proportion for ease of removability of the accessory, particularly for auxiliary uses in connection with the item that includes the housing, is applicable in other contexts as well.

It is also to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A vehicle comprising a housing;

an aperture in said housing;

an accessory which is receivable in siad aperture and engageable in said housing for use in the operation of said vehicle and is also releasable thereform for auxiliary uses in connection therewith;

said accessory comprising a handle that can be used in manuevering said vehicle and being provided with a shovel blade at the portion thereof which is engageable in said aperture; said aperture forming a "T"-shaped slot with the "T" portion thereof receiving the shovel blade and the stem of the "T" portion guiding said handle and the housing includes an internal semicircular track to permit the rotation of said blade.

2. A vehicle in accordance with claim 1 wherein a second internal semicircular track is included within said housing to provide added support for the rotation of said blade.

3. A vehicle in accordance with claim 2 wherein the semicircular tracks are on opposite sides of the stem of said "T" shaped slot.

4. A vehicle in accordance with claim 3 wherein the portion of said handle is connected to said blade has an upper curved surface to facilitate the release of said blade from said housing when said handle is elevated towards the crossbar of said "T" shaped slot.

5. A vehicle in accordance with claim 4 wherein the stem of said "T" shaped slot has substantially the same width as the tongue of said handle.

6. A vehicle in accordance with claim 5 wherein said housing constitutes a cap portion, the crossbar of said "T" shaped slot is in the roof thereof, and the stem of said slot is in the front thereof.

* * * * *